US008550010B2

(12) United States Patent
Cummings

(10) Patent No.: US 8,550,010 B2
(45) Date of Patent: Oct. 8, 2013

(54) BULK MATERIALS CONTAINER

(75) Inventor: Douglas Gordon Cummings, Coal Point (AU)

(73) Assignee: Bradken Resources Pty Limited, Mayfield West (AU)

( * ) Notice: Subject to any disclaimer, the term of this patent is extended or adjusted under 35 U.S.C. 154(b) by 253 days.

(21) Appl. No.: 11/884,470

(22) PCT Filed: Dec. 8, 2005

(86) PCT No.: PCT/AU2005/001860
§ 371 (c)(1),
(2), (4) Date: Feb. 8, 2008

(87) PCT Pub. No.: WO2006/086824
PCT Pub. Date: Aug. 24, 2006

(65) Prior Publication Data

US 2009/0211485 A1 Aug. 27, 2009

(30) Foreign Application Priority Data

Feb. 17, 2005 (AU) ..... 2005900742

(51) Int. Cl.
*B61D 17/08* (2006.01)

(52) U.S. Cl.
USPC ..... 105/409; 105/404; 105/406.1; 105/411; 296/186.1

(58) Field of Classification Search
USPC ..... 105/422, 404, 401, 406.1, 409, 410, 105/407, 411, 72.2; 296/178, 182.1, 181.1, 296/183.1, 186.1, 191
See application file for complete search history.

(56) References Cited

U.S. PATENT DOCUMENTS

| | | | | | |
|---|---|---|---|---|---|
| 1,432,911 | A | * | 10/1922 | Schlesinger | 105/406.1 |
| 2,626,573 | A | * | 1/1953 | Swann | 105/406.1 |
| 3,688,080 | A | * | 8/1972 | Cartwright et al. | 219/137 R |
| 4,037,775 | A | | 7/1977 | Bamburg et al. | |
| 4,252,067 | A | * | 2/1981 | Stark | 105/406.1 |
| 4,828,132 | A | | 5/1989 | Francis, Jr. et al. | |
| 5,335,603 | A | * | 8/1994 | Wirick et al. | 105/406.1 |
| 5,433,501 | A | | 7/1995 | Thomas et al. | |
| 5,460,291 | A | | 10/1995 | Kerstiens | |
| 5,509,714 | A | * | 4/1996 | Schmidt | 296/186.1 |
| 5,595,670 | A | * | 1/1997 | Mombo-Caristan | 219/121.64 |

(Continued)

FOREIGN PATENT DOCUMENTS

| | | | |
|---|---|---|---|
| DE | 3637335 | A1 | 5/1988 |
| DE | 29723338 | U1 | 8/1998 |
| JP | 10-119966 | A | 5/1998 |
| JP | 2003-146331 | A | 5/2003 |

OTHER PUBLICATIONS

International Search Report dated Mar. 17, 2006 directed to counterpart application PCT/AU2005/001860 (5 pages).

*Primary Examiner* — Mark Le
(74) *Attorney, Agent, or Firm* — Morrison & Foerster LLP

(57) ABSTRACT

A wagon has two side walls, two end walls and a base. At least a portion of one or each side wall has two side wall parts in the form of panels. Each panel has a respective constant wall thickness and is joined together. In some embodiments, the panels can be integrally formed. The side wall panels are also each of a different material thickness. A bridging member in the form of an angled bracket is arranged to interconnect the respective side wall panels by being separately connected to each side wall panel.

17 Claims, 8 Drawing Sheets

(56) References Cited

U.S. PATENT DOCUMENTS

| | | | | |
|---|---|---|---|---|
| 5,876,089 | A * | 3/1999 | Ehrlich | 296/186.1 |
| 5,967,356 | A | 10/1999 | Laarhoven et al. | |
| 6,010,020 | A | 1/2000 | Abal | |
| 6,244,191 | B1 | 6/2001 | Lydic | |
| 6,290,285 | B1 * | 9/2001 | McCormack | 296/182.1 |
| 6,302,031 | B1 | 10/2001 | Smith et al. | |
| 6,439,131 | B1 * | 8/2002 | Higgins | 105/215.2 |
| 6,571,719 | B2 * | 6/2003 | MacDonald | 105/404 |
| 6,892,498 | B1 * | 5/2005 | Roman | 52/79.5 |
| 6,988,761 | B1 * | 1/2006 | Stidham et al. | 296/186.1 |
| 2002/0180238 | A1 | 12/2002 | Sill | |
| 2003/0160049 | A1 | 8/2003 | Reiter et al. | |
| 2004/0045476 | A1 | 3/2004 | Bianchi | |
| 2004/0232728 | A1 * | 11/2004 | Smidler | 296/186.1 |

* cited by examiner

DETAIL 1

DETAIL 2

BULK MATERIALS CONTAINER

FIELD OF THE INVENTION

The present invention relates generally to a bulk material transport container. In one form the container can be used as part of a railway wagon and will primarily be described with reference to this context. It should be remembered, however, that the invention has broader use in all manner of transportation applications where bulk material movement is required.

BACKGROUND TO THE INVENTION

Articulated railway freight trains and trucks which utilise containers for carriage of bulk materials (such as mineral ores, grains and the like) are known. In rail applications, the bulk materials container can be seated on an elongate wagon undercarriage which itself is connected to two bogies located near either end of the wagon undercarriage. The bogies includes wheel sets and a bolster to which the wagon undercarriage is mounted via an articulated connection or centreplate device. The articulated connection is provided by mating a male member of the under frame and a female component of the bogie bolster.

The aim in railway freight wagon design is to maximise the weight of material to be carried by the wagon and also to maximise the gross to tare ratio (total weight of loaded wagon compared with the weight of the wagon when empty). If the weight of a railway wagon itself can be minimised, the weight of bulk material to be carried in the wagon can be increased, for a given total load limit on a railway line structure. Such considerations can determine whether a railway wagon design is economically suitable for a particular purpose. Therefore great emphasis is placed on the development of lightweight freight wagon componentry.

In an effort to reduce the weight of a bulk material container, one known method is to reduce the thickness of the container side walls. However, if the side walls of the bulk material container portion of a railway wagon are made too thin, this can lead to outward deformation of the walls when the wagon is loaded with particular bulk materials. The wagon can become stuck in loading facilities or in tunnels etc when overloaded in this manner. Furthermore, if deformed in this way, the walls can become severely stressed when the wagon is in motion and may even buckle or burst, with catastrophic results.

SUMMARY OF THE INVENTION

In a first aspect the present invention provides a railway wagon for carrying bulk materials, the wagon comprising two side walls, two end walls and a base, at least a portion of one or each side wall comprises two side wall parts, each part having a respective constant wall thickness and being joined together or integrally formed, wherein the side wall parts are each of a different material thickness.

By having walls which have side wall parts of a different thickness, the tare weight of the wagon itself can be reduced without comprising the strength of the wagon side walls under load. The side walls can be of a greater material thickness in those places where high stresses or hydrostatic loads are expected, and of a lesser material thickness where such loads and stresses are lower. In this way the tare weight of the wagon can be reduced, and thus the weight of bulk material to be carried by the wagon, and the gross to tare ratio of the wagon when loaded, can be improved.

When the term "constant wall thickness" is used throughout this specification it is not to be construed so narrowly as to exclude those side wall parts which may have some minor variations in thickness due to pitting, surface roughness, warping or other deformations which may occur during formation in standard manufacturing processes with a selected material. Because the side wall parts are of a constant wall thickness, it is possible to use standard-shape commercially-available materials, for example wall sheets etc.

The two side wall parts can be disposed one above the other to form the wagon side wall. In one arrangement, the two side wall parts can partially overlap and be joined at the overlap, whilst in other arrangements the side wall parts can be integrally formed, and, for example can be heated and drawn to different material thicknesses in different locations. When joined, the join at the overlap can be achieved by means of a weld. In one form, the weld can be a stitch weld. In such an arrangement, a bridging member can be arranged to interconnect each of the respective side wall parts to provide additional side wall stiffness and strength.

In a second aspect the present invention provides a railway wagon for carrying bulk materials, the wagon comprising two side walls, two end walls and a base, at least a portion of one or each side wall comprising two discrete side wall parts, wherein a bridging member is arranged to interconnect the respective side wall parts by being separately connected to each side wall part, the bridging member being elongate and arranged in use to extend at least part way along a respective side wall from one end wall to an opposing end wall.

The bridging member can be used to join two side wall parts of dissimilar material thicknesses or shape, or even of dissimilar material composition or strength which may not lend themselves to be joined otherwise. Using the bridging member to interconnect each of the respective side wall parts can provide additional side wall stiffness and strength when the wagon is loaded with bulk materials. The separate connection of the bridging member to each side wall part can provide stabilisation of the side wall, especially if located across a join between two side wall parts that have been joined together.

The bridging member of the first aspect may also be elongate and arranged to extend at least part way along a respective side wall. In one form, the bridging member of the first or the second aspect can extend substantially along the side wall from one end of the side wall where the side wall meets the wagon end wall, to an opposing end of the side wall. However, such an elongated bridging member may be replaced in less preferred embodiments, by a row of spaced apart (or even adjacent), shorter lengths of the same type of bridging member. Thus the term "bridging member" as used herein is to be construed not only as a single elongated item, but also as a functionally equivalent row of spaced apart (or adjacent) shorter sections of such an item.

The distal end regions of the bridging member can be welded to the respective ones of the side wall parts. In one form, the weld between each of the distal ends of the bridging member and the side wall parts can be a continuous weld. In other forms, these bridging members could be attached to the wagon walls by an adhesive substance, welding, screwing, bolting, forging or riveting, for example.

In one particular form, the bridging member can incorporate first and second mutually inclined parts, and for example, the bridging member can have an L-shaped profile in cross-section. Other angles and shapes are possible, including curved parts that can be convex or concave in configuration. The bridging member may be smoothly curved throughout or it may comprise straight portions meeting at relatively abrupt angles, or a combination of both of these possibilities.

The bridging member can be positioned so as to face an interior of the wagon, said interior being the region bounded by the side walls, end walls and base. The exterior side wall of the wagon therefore does not have an outward facing protrusion for reasons of aerodynamic efficiency.

In one embodiment, where the side wall parts are spaced apart, the wagon can further comprise a third side wall part interconnecting said first and second side wall parts.

In any of the embodiments described, the side wall parts can each be panels that are aligned to be substantially coplanar so that the wagon side wall is substantially vertical and smooth for reasons of aerodynamic efficiency.

In one arrangement of this, the panels can be disposed one above the other and said bridging member extends along said wall, intermediate the upper and lower ends of said side wall. A capping can also be joined to one of said wall parts so as to form at least part of an upper edge of said side wall, and a second bridging member arranged to interconnect said capping and said wall part.

In another form, the wagon of the first or second aspects can have one of the said side wall parts being a panel and the other side wall part a capping that forms at least part of an upper edge of said side wall.

In one form of this, the capping has a first portion that is joined to the panel and a second portion that is angularly disposed from the first portion. The bridging member can extend from the second portion to the panel so as to form a closed section at an upper edge of the side wall. The capping can have an L-shaped profile in cross-section and be positioned atop the side wall panel and at a rim of an opening to the interior of the wagon. Other capping shapes are possible. The capping itself, and the capping in conjunction with the bridging member, can provide side wall stiffness and strength at the uppermost portion of the wagon side wall, which is particularly useful to resist wall deformation when the wagon is tipped or inverted to unloaded bulk materials.

In a third aspect, the present invention provides a railway wagon for carrying bulk materials, the wagon comprising two side walls, two end walls and a base, at least a portion of the base comprising two floor parts that are joined together or integrally formed, wherein the floor parts are each of a different material thickness.

By having a base which has side wall parts of a different thickness, the tare weight of the wagon itself can be reduced without comprising the strength of the wagon base under load. The base can be of a greater material thickness in those places where high stresses or hydrostatic loads are expected, and of a lesser material thickness where such loads and stresses are lower, or where the base is supported by other means. For example, the floor parts can be of a thinner material thickness in the centre region where that part of the floor can be supported by the centre sill of a railway wagon undercarriage, and of a thicker material thickness in the outermost region away from the centre sill and nearest the wagon side walls where the floor part is required to support the full hydrostatic weight of the bulk material contents of the wagon. In this way the tare weight of the wagon can be reduced, and thus the weight of bulk material to be carried by the wagon, and the gross to tare ratio of the wagon when loaded, can be improved.

The two floor parts can be disposed one alongside the other. In one arrangement of a portion of the base, the two floor parts can partially overlap and be joined at the overlap, whilst in other arrangements the side wall parts can be integrally formed, and, for example can be heated and drawn to different material thicknesses in different locations.

If there is an overlap, it can be arranged intermediate a centreline of the wagon base and one of the side walls. The base can include a plurality of wheel arches and the or each overlap can extend along a respective one of those wheel arches. The wheel arches need not extend along the full length of the wagon base, and may instead only be recesses at some portions along the length of the base.

In one embodiment, the base can comprise three said floor parts, a first floor part that is disposed between a second and a third floor part, the first floor part being of a thinner material thickness than either the second or third floor parts.

In any of the forms of the floor described, the join at the or each overlap may be achieved by means of at least one weld. The base can have opposing inner and outer surfaces, where the inner surface faces toward an interior of the wagon, said interior being the region bounded by the side walls, end walls and base, and wherein a said weld is continuous and disposed along the inner surface at the overlap. In addition, a second weld can be disposed on the outer surface at the overlap, said second weld being a stitch weld.

In any of the forms described, the floor parts can each be panels that are aligned to be substantially horizontally coplanar.

In some arrangements, the bulk material carrying wagon of the third aspect is otherwise as defined in the first or second aspects.

In a fourth aspect the present invention provides a railway wagon for carrying bulk materials, the wagon comprising two side walls, two end walls and a base, at least a portion of one or each side wall comprises two side wall parts that are joined together, wherein the side wall parts are each of a different material thickness.

By having walls which have side wall parts of a different thickness, the tare weight of the railway wagon itself can be reduced without comprising the strength of the wagon side walls under load. The side walls can be of a greater material thickness in those places where high stresses or hydrostatic loads are expected, and of a lesser material thickness where such loads and stresses are lower. In this way the tare weight of the railway wagon can be reduced, and thus the weight of bulk material to be carried by the wagon, and the gross to tare ratio of the wagon when loaded, can be improved.

In some arrangements, the railway wagon of the fourth aspect comprises a wagon which is otherwise as defined in the first, second or third aspects.

In the construction of steel railway wagons used for bulk material transportation, one of the main techniques for joining adjacent metal sheets to form a wagon side wall or floor involves butt welding the sheets together (ie welding two adjacent edges of sheet material together along the respective adjoining edges). This technique provides a very strong join between two sheets but is complex to undertake and relies on the sheet materials not becoming warped or bent, and the adjacent edges of the sheet material being tolerably straight to allow a satisfactory butt weld to be made. If the sheet material needs to be re-cut or re-formed in some way to achieve a good butt weld, this can add significantly to costs due to excessive construction time and wastage of material.

In any of the arrangements of the first, second, third or fourth aspects, where a weld is used in construction to join two respective side wall parts or two respective floor parts of a wagon, the use of an overlap of material does not require the use of butt edge welding techniques because the sheet(s) of metal material used do not need to have accurate end cuts or alignment. A stitch weld provides an adequate and rapid method of joining two adjacent parts, and in some of the embodiments described, such a weld can be supplemented by the use of a continuous weld on another side of the overlap or by the use of a separate bridging member. Consequently the construction of those wagons can be simplified and material wastage reduced.

BRIEF DESCRIPTION OF THE DRAWINGS

In order to facilitate a better understanding of the nature of the present invention a preferred embodiment of a railway wagon for carrying bulk materials will now be described in some detail, by way of example only, with reference to the accompanying drawings in which.

DETAILED DESCRIPTION OF EMBODIMENTS

Figure 1:
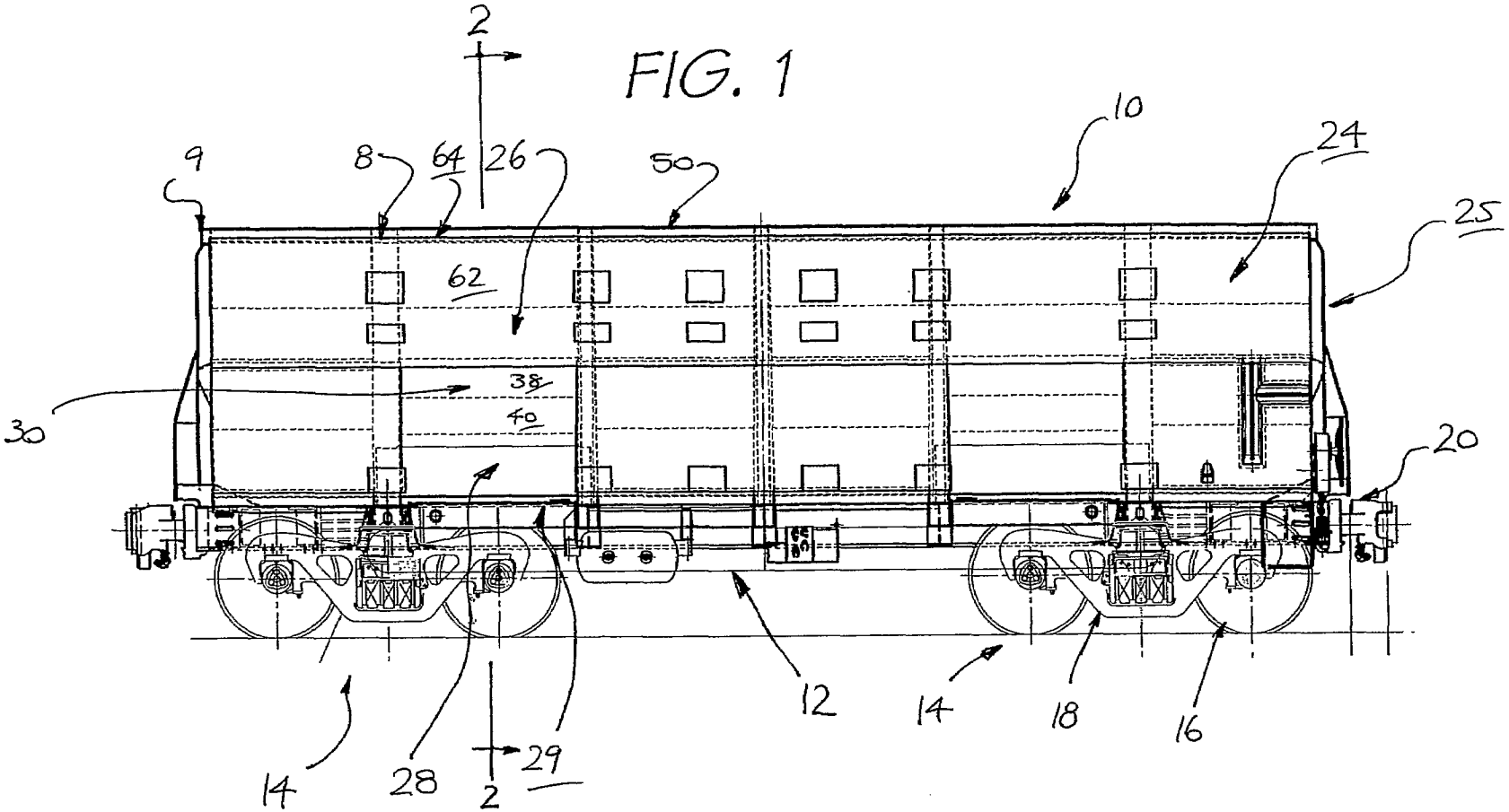
FIG. 1 is a side view of a bulk material railway wagon in accordance with the invention.
Figure 2:
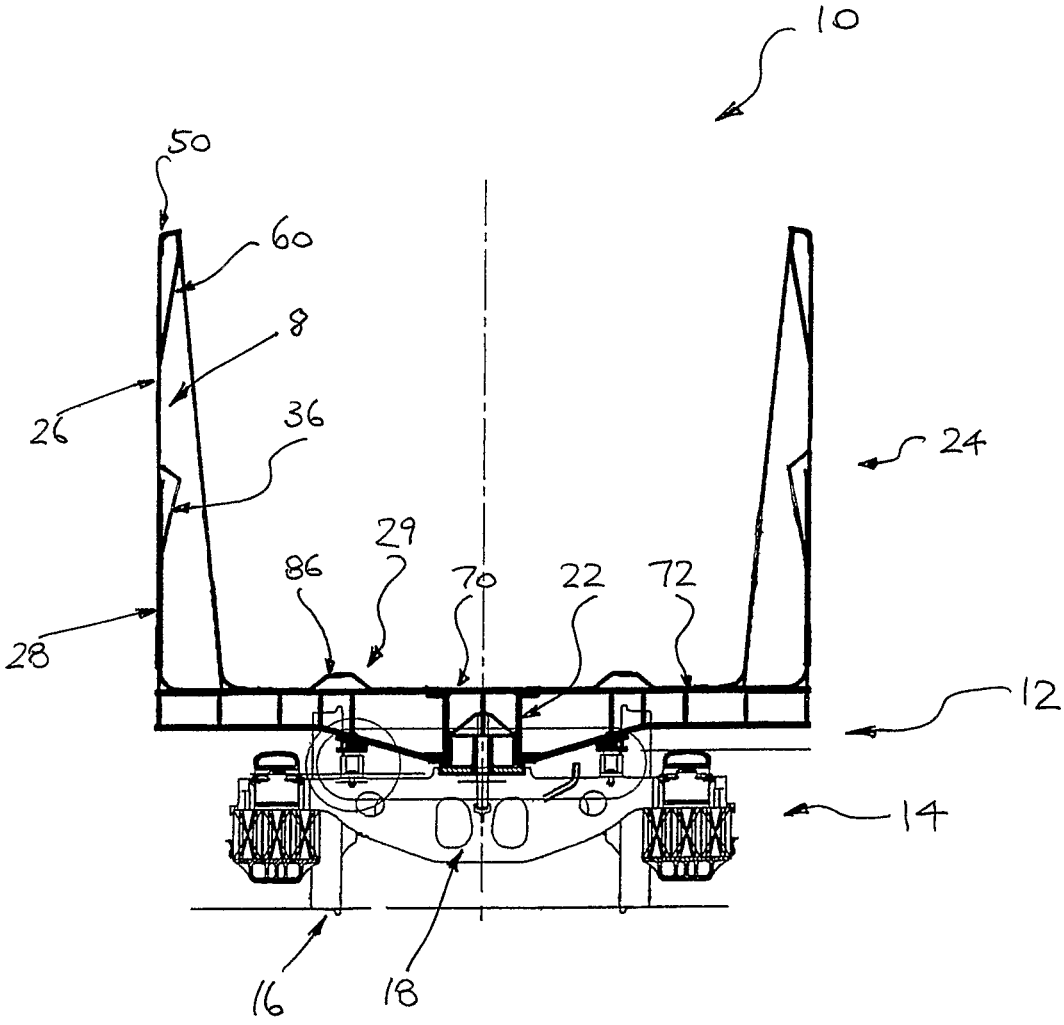
FIG. 2 is a cross-sectional view of the wagon of FIG. 1 when viewed along line 2-2.
Figure 3:
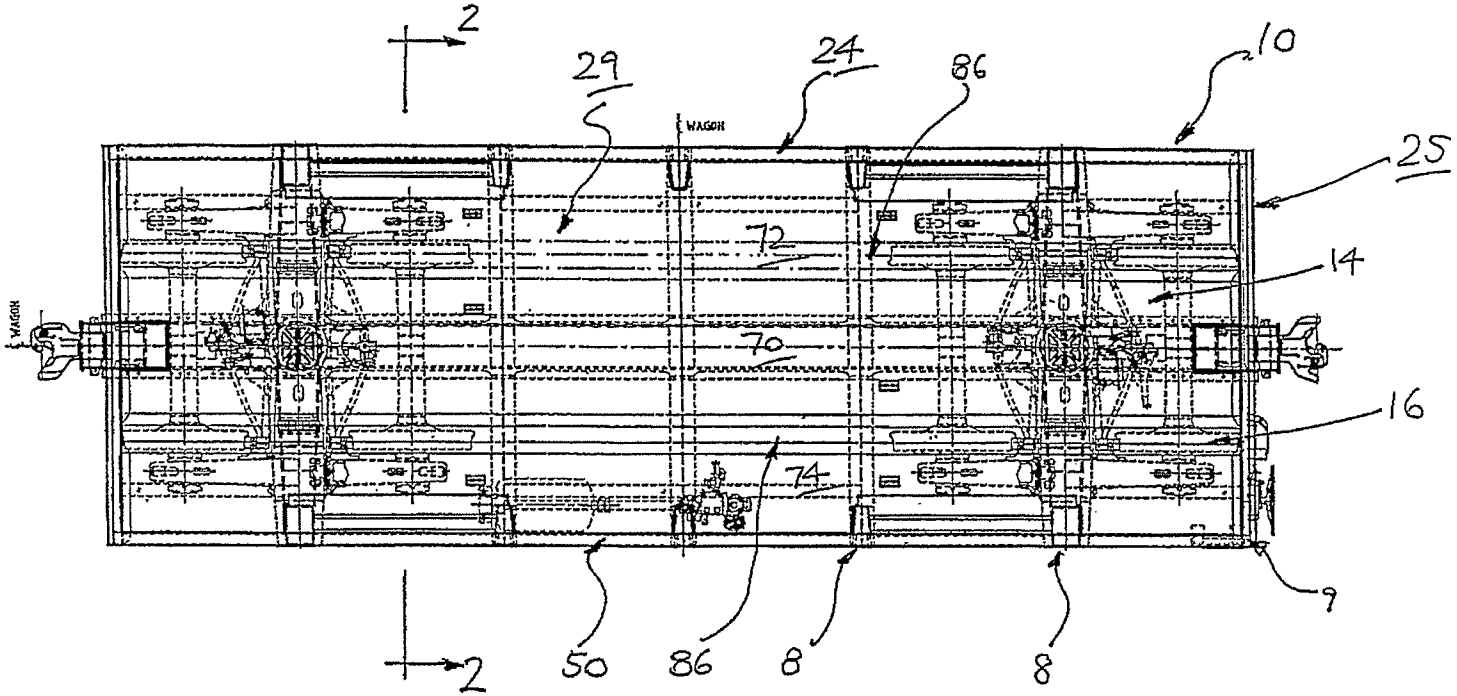
FIG. 3 is a plan view of the wagon of FIG. 1.

As shown in FIGS. 1 to 3 there is a bulk material transport container 10 which is positioned and supported a top an elongate railway wagon undercarriage 12. The undercarriage 12 is connected to two bogies 14 located near both ends of the wagon undercarriage 12, the bogies 14 including wheel sets 16 and a bolster 18 to which the wagon undercarriage 12 is mounted via a coupler 20. The coupler 20 is joined into the centre sill 22 of the wagon undercarriage 12.

The container 10 shown has two side walls, generally shown at item 24, two end walls, generally shown at item 25 and a base, generally shown at item 29. The side walls 24 are shown in more detail in FIGS. 4, 4*a* and 4*b*. The side wall 24 is made up of a series of five vertical support posts 8 which are spaced apart along the length of the container 10. There are two further end posts 9 which are located at the centre of the end walls 25, and which stand directly above the couplers 20.

The posts 8 support various side wall panel sheets which form the exterior skin or surface of the outside of the container 10. Bridging the space between the first and second vertical support posts 8 (as counted from either end of the container) are two panels 26, 28 which are disposed one above the other in a vertical plane. The two side wall panels 26, 28 have an overlap region, generally shown at item 30, where the uppermost panel 26 overlaps the lowermost panel 28 on an external face of the side wall 24. The resulting side wall presents a substantially smooth surface or skin when viewed from outside the container 10. The sheets which make up the end walls 25 are joined to the side panels 26, 28 by a continuous fillet weld on at least one side of the T-junction of the two sheets.

The uppermost panel 26 shown is made of a thinner material thickness than the lowermost panel 28. Both of these side wall panels 26, 28 have a respective constant side wall thickness overall, and are typically made of sheet metal (such as steel, alloyed steel or aluminium). In the embodiment shown, the panels 26, 28 are joined together by stitch welding located at various positions along the lowermost edge 32 of the uppermost panel 26 and along the uppermost edge 34 of the lowermost panel 28.

A bridging member can be used to join two side wall panels of dissimilar material thicknesses or shape, or even of dissimilar material composition or strength which may otherwise not lend themselves to be joined. In the embodiment shown, a bridging member in the form of an angled bracket 36 made up of two mutually inclined panels 38, 40 (in this case angled apart by an obtuse angle of around 130 degrees) is welded to each of the uppermost 26 and lowermost 28 wall panels to provide additional side wall stiffness and strength. The bracket is only shown in hidden detail in FIG. 1. The bracket 36 extends into the interior of the container 10. In the embodiment shown, the lowermost distal end region 42 of the panel item 40 of the bracket 36 is welded to the lowermost side wall panel 28, and the uppermost distal end region 44 of the panel item 38 of the bracket 36 is welded to the uppermost side wall panel 26. The welds which join respective end regions of the bracket 36 to the respective panels 26, 28 are a continuous weld, principally for strength and to prevent the ingress of bulk material dust into the cavity defined between the container side wall panels 26, 28 and the bracket 36 itself during use of the container.

In the embodiment shown in the Figures, the angled bracket 36 is elongate and extends between the first and second vertical support posts 8 (as counted from either end 25 of the container 10) along each side wall 24 of the container 10. In other embodiments, an angled bracket can extend along the full length of the container side wall from one end of the side wall where the side wall meets the container end wall, to an opposing end of the side wall. In still further embodiments, a plurality of shorter length brackets for side wall reinforcement can be arranged in between the first and second vertical support posts 8 (as counted from either end of the container).

In further embodiments, the side wall panels need not be disposed one above the other in a vertical plane, but can be angularly disposed with respect to each other. The panels themselves do not need to be planar, but can be curved or formed into other suitable geometric shapes, depending on the application and the desired shape of the container side wall. Instead of the uppermost panel being of a thinner material thickness than the lowermost panel, the reverse configuration could be arranged. Although the panels in the embodiment shown in the drawings are joined by stitch welding, other types of welding, such as continuous welding, may be utilised. Indeed, other methods of joining the side wall panels are also envisaged, for example involving use of an adhesive substance, heat treating the join region to cause fusion of the panels, or physical connection means such as screwing, bolting, forging or riveting, etc. Any number of side wall vertical support posts can be spaced apart along the length of the container.

In still further embodiments, the bridging member can be in the form of an angled bracket made up of two or more mutually inclined panels which can be of other shapes (for example convex or concave panels) and at other angles of relative disposition. In still further embodiments, the bridging member can be semicircular in cross-section and smoothly curved throughout. Other methods of joining the bracket to the side wall parts of the container are also envisaged, for example involving an adhesive substance, welding, screwing, bolting, forging or riveting, etc.

In still further embodiments, the side wall which forms the exterior surface or skin of the outside of the container can be made up of unitary sheets, with one sheet positioned between respective vertical support posts 8, and/or between a vertical support post 8 and the corner of the container where the side wall meets the end wall. The sheet(s) can be integrally formed to have different material thicknesses, for example, by being heated and then drawn or rolled, so that a first part of such a sheet is relatively thinner than a second part of the sheet.

Figure 7:
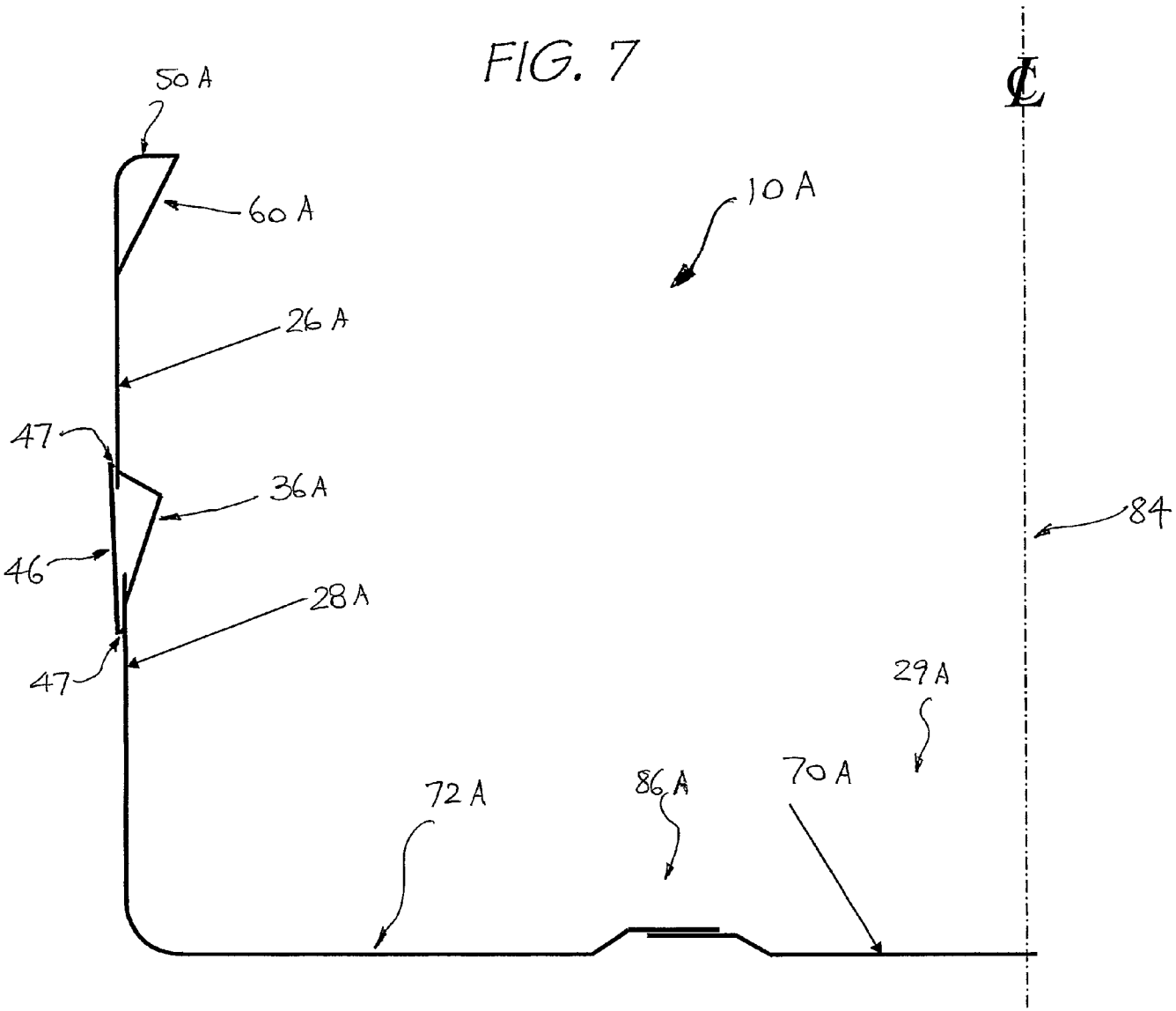
FIG. 7 is a schematic cross-sectional view of a bulk material transport wagon in accordance with the invention, the Figure showing a portion of the floor and one side wall of the wagon.

Referring now to FIG. 7, a further embodiment of a side wall of container is shown. Apart from the specific features of how the side wall parts are arranged in the form of spaced apart panels 26A, 28A, this embodiment is similar in all other respects to that shown and described in relation to FIGS. 1-4. In order to avoid repetition, and for ease of reference, similar components and features of this alternative embodiment of the invention have been designated with an additional "A", such as the angled bracket 36A.

In this embodiment, two panels 26A, 28A are disposed one above the other in a vertical plane. The uppermost panel 26A shown is made of a thinner material thickness than the lowermost panel 28A. These two side wall panels 26A, 28A do not have an overlap region where the uppermost panel 26A meets the lowermost panel 28A and are, in fact, discrete.

In the embodiment shown, a bracket 36A is shown which in all respects is similar to the bracket 36 previously described, with the exception that in the particular form shown in FIG. 7, the two mutually inclined panels 38A, 40A of the bracket 36A are angled apart by an obtuse angle of around 100 degrees.

So that the resulting side wall can advantageously present a substantially smooth surface or skin when viewed from outside the container 10A, in the embodiment shown in FIG. 7 a flat panel 46 is stitch welded at its periphery 47 over the gap between the uppermost panel 26A and the lowermost panel 28A to interconnect these panels 26A, 28A. The exterior side wall 24A of the container in this portion of the side wall 24A is therefore smooth and does not have any visible recess, for reasons of aerodynamic efficiency. The recess defined by the interior of the bracket 36A is therefore enclosed by the flat panel 46.

In further embodiments of this type of side wall, the discrete side wall panels need not be disposed one above the other in a vertical plane, but can be angularly disposed with respect to each other. The panels themselves do not need to be planar, but can be curved or formed into other suitable geometric shapes, depending on the application and the desired shape of the container side wall. Instead of the uppermost panel being of a thinner material thickness than the lowermost panel, the reverse configuration could be arranged.

Figure 4:
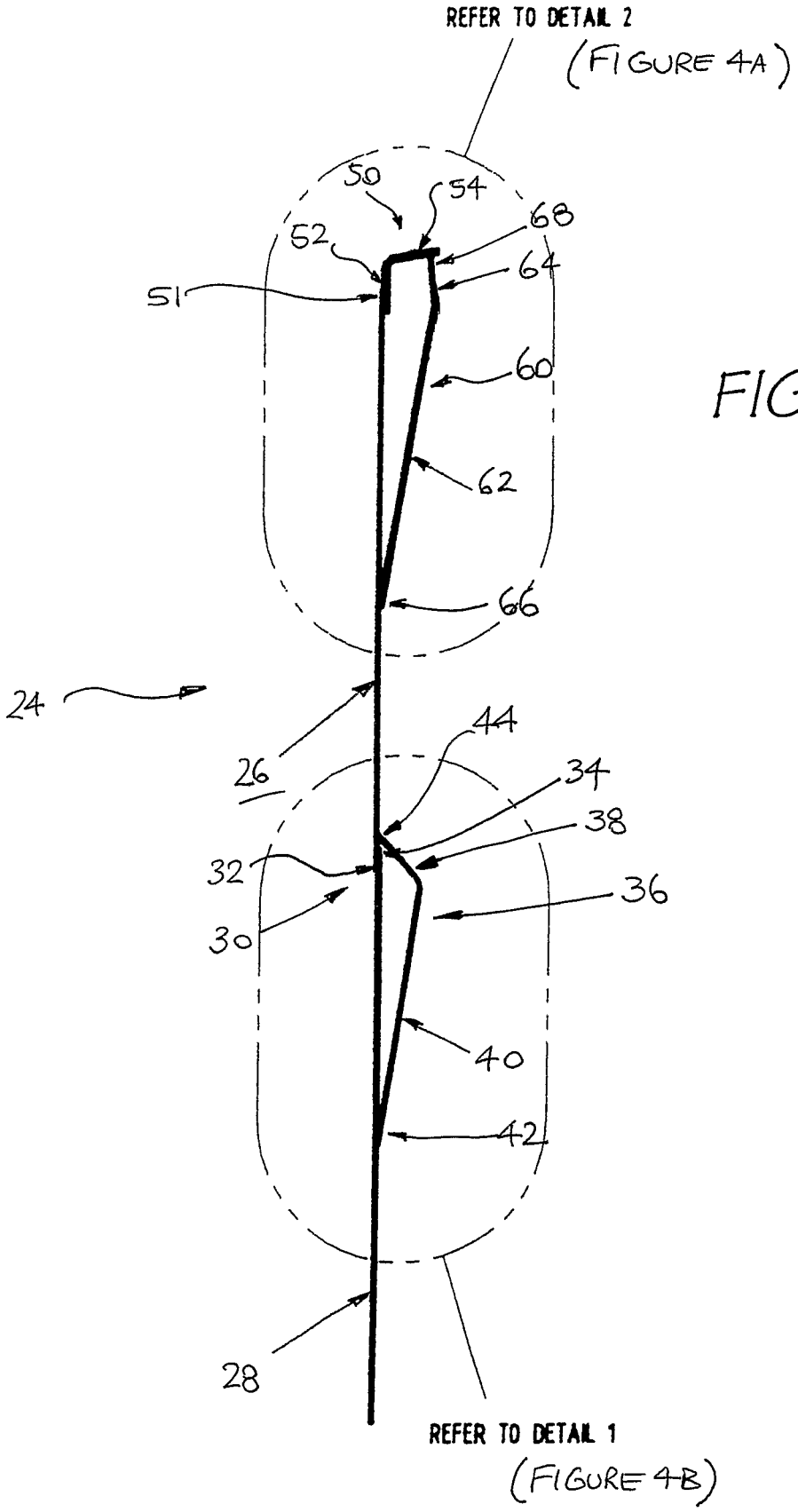
FIG. 4 is a cross-sectional view of a side wall portion of the wagon of FIG. 1.
Figure 4A:
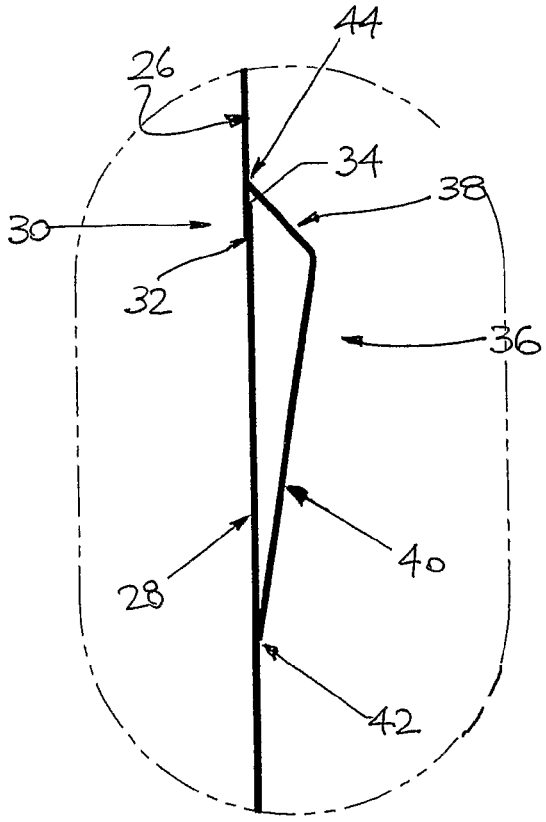
FIG. 4*a* is a detailed view of a portion of the side wall portion shown in FIG. 4.
Figure 4B:
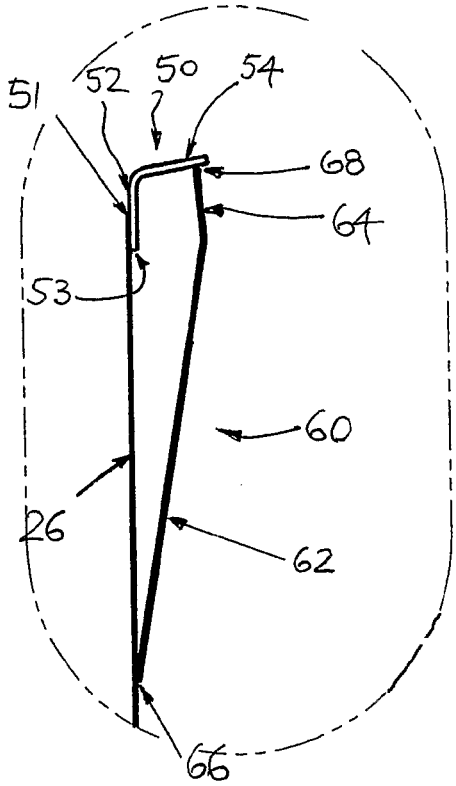
FIG. 4*b* is a detailed view of another portion of the side wall portion shown in FIG. 4.

Referring now to FIGS. 2, 4 and 4*b*, the container can have one side wall part being a panel 26 and the other side wall part being a capping that is sealed at an upper edge 51 of the container side wall 24. As shown in the drawings, there is a capping in the form of a bracket 50 that is L-shaped in profile and made up of two planar arms 52, 54 mutually disposed at an angle of around 100 degrees from one another. The L-shaped bracket 50 is positioned at the uppermost edge 51 of the side wall panel 26. The panel 26 is made of a thinner material thickness than the bracket 50. In the embodiment shown, the panel 26 and the L-shaped bracket 50 are joined together by stitch welding, at various positions along the uppermost edge 51 of the side wall panel 26, at a position midway along one side of one arm 52 of the L-shaped bracket 50 and also at a position along the lowermost edge 53 of the arm 52 of the bracket 50. The location of the L-shaped bracket 50 along the rim of the uppermost portion 51 of the container side wall 24 (and around the opening to the interior of the container 10) can provide side wall stiffness and strength, which is particularly useful to resist wall deformation when the container 10 is tipped or inverted to unloaded bulk materials.

In the embodiment shown, a bridging member in the form of an angled bracket 60 made up of two mutually inclined panels 62, 64 (in this case angled apart by an obtuse angle of around 160 degrees) is welded to each of the uppermost wall panel 26 and the L-shaped bracket 50 to form a closed section. This can provide additional wall stiffness and strength at the rim of the container 10. The bracket 60 is only shown in hidden detail in FIG. 1. The bracket 60 extends into the interior of the container 10. In the embodiment shown, the lowermost distal end region 66 of the panel item 62 of the bracket 60 is welded to the side wall panel 26, and the uppermost distal end region 68 of the panel item 64 of the bracket 60 is welded to the arm 54 of the L-shaped bracket 50. The welds which join respective end regions of the bracket 60 to the respective panel 26 and arm 54 of the L-shaped bracket 50 are a continuous weld, principally for strength and to prevent the ingress of bulk material dust into the cavity defined between the container side wall panel 26, the L-shaped bracket 50 and the bracket 60 itself during use of the container 10.

In the embodiment shown in the Figures, the angled bracket 60 is elongate and extends fully along the uppermost edge 51 of each side wall 24 of the container 10 from one end of the side wall 24 where the side wall 24 meets the container end wall 25, to an opposing end wall 25. In other embodiments, such a bracket need not extend along the full length of the container side wall. In such embodiments, a plurality of shorter length brackets for side wall reinforcement can be arranged in between specific vertical support posts 8 only.

In further embodiments, the capping on the upper side wall panel need not be an L-shaped bracket but can be of other shapes, for example with arms that are acutely angularly disposed with respect to each other. Also, the capping can be in the form of an inverted U-shaped channel, for example. Instead of the side wall panel being of a thinner material thickness than the capping, the reverse configuration could be arranged. Although the uppermost side wall panel in the embodiment shown in the drawings is joined to the capping by stitch welding, other types of welding, such as continuous welding, may be utilised. Indeed, other methods of joining the side wall panel to the capping are also envisaged, for example involving use of an adhesive substance, heat treating the join region to cause fusion of the panel and capping, or physical connection means such as screwing, bolting, forging or riveting, etc.

FIG. 4 shows an embodiment in which two side wall panels 26, 28 are disposed one above the other to form a container side wall 24, and are joined by a bridging member in the form of a bracket 36 which extends along an intermediate region of the side wall. A capping in the form of an L-shaped bracket 50 is joined to the uppermost edge 51 of the wall panel 26 to form a rim of the container, and a second bridging member in the form of an angled bracket 60 is arranged to interconnect the L-shaped bracket 50 and the uppermost side wall panel 26.

Figure 5:
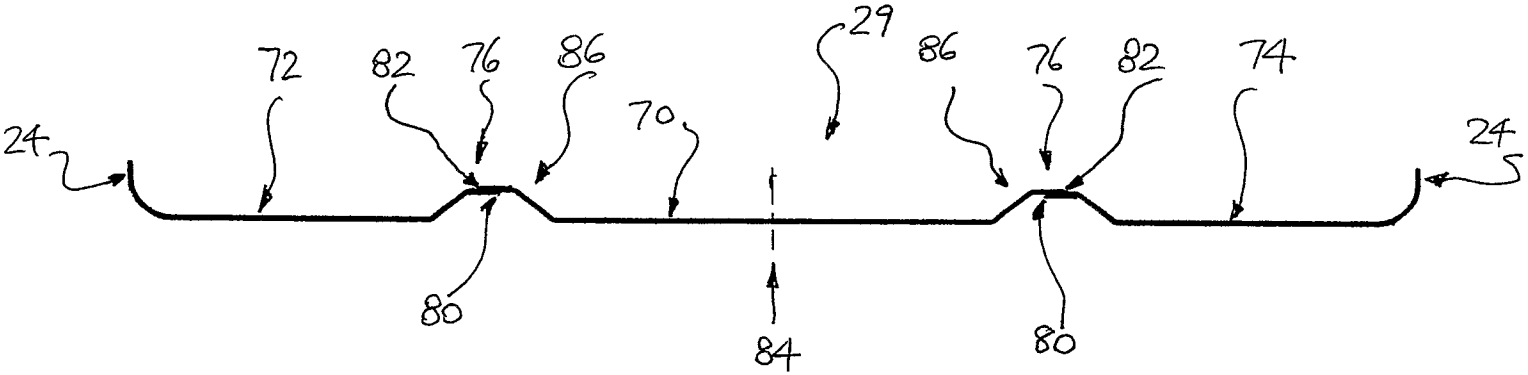
FIG. 5 is a detailed view of the floor portion of the wagon shown in cross-section in FIG. 2.
Figure 6:
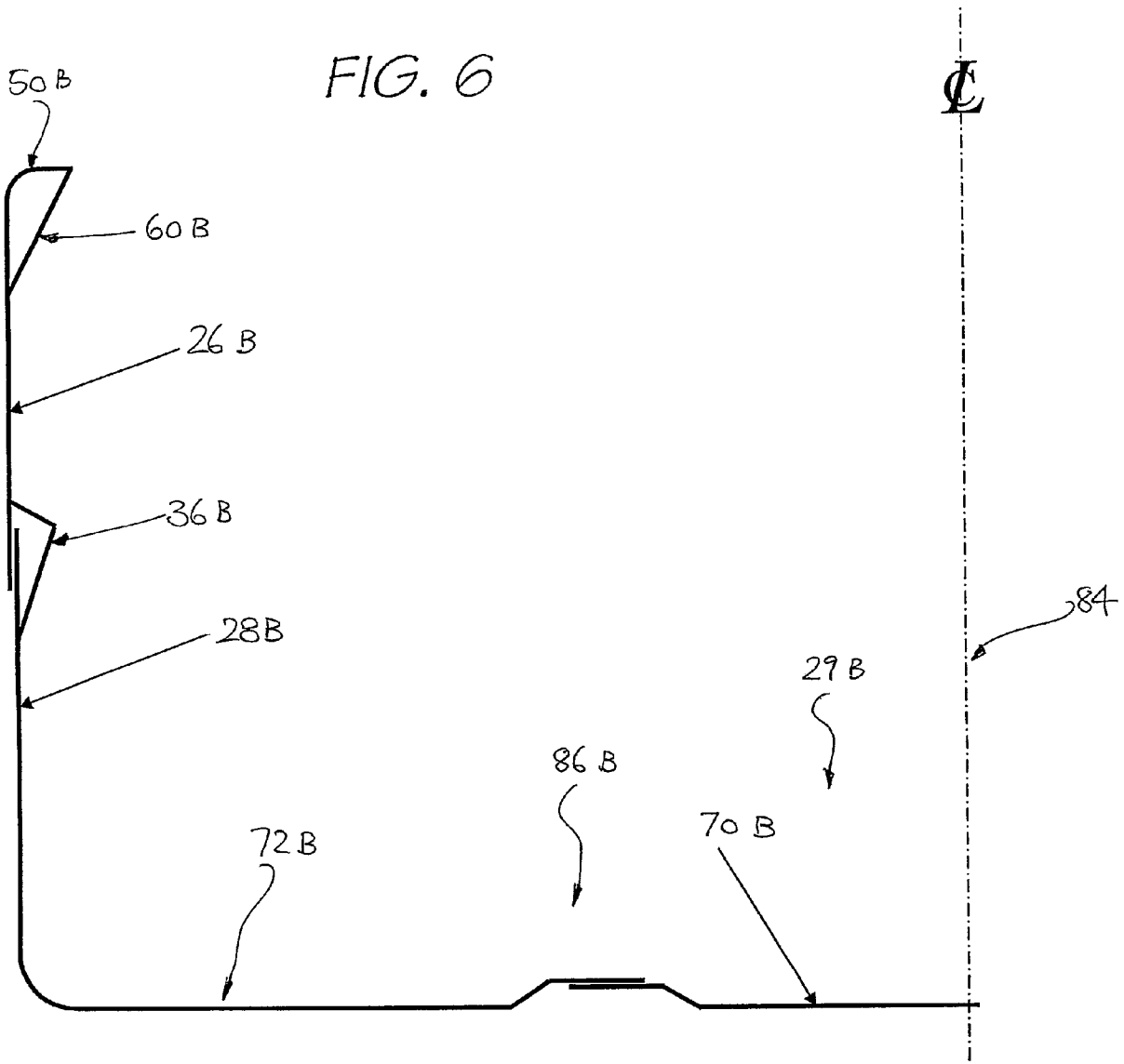
FIG. 6 is a schematic cross-sectional view of a bulk material transport wagon in accordance with the invention, the Figure showing a portion of the floor and one side wall of the wagon.

Turning now to FIGS. 2, 5 and 6, the floor 29 of the container 10 is made up of three parts that are disposed one alongside the other in a generally horizontal plane. In the embodiment shown, the central floor panel 70 of the base is arranged with a partial overlap with each of two adjacent side floor panels 72, 74 that are located on either side of the central panel 70 and at the outermost lateral edges of the container floor 29. The two side floor panels 72, 74 have an overlap region, generally shown at item 76, where the central floor panel 70 overlaps and rests above each side floor panel 72, 74. Each side floor panel 72, 74 is joined at the respective overlap with the central floor panel 70. The resulting floor 29 presents a substantially smooth surface when viewed from interior the container 10. Each of the side floor panels 72, 74 are also joined to a respective side wall 24 of the container 10.

In FIG. 6, a further embodiment of a side wall and floor of a container is shown. This embodiment is similar in most respects to that shown and described in relation to FIGS. 1-4. In order to avoid repetition, and for ease of reference, similar components and features of this alternative embodiment of the invention have been designated with an additional "B", such as the angled bracket 36B.

In an alternative embodiment shown in FIG. 6, the floor of the container 29B can have a central floor panel 70B arranged with a partial overlap with each of two adjacent side floor panels 72B that are located on either side of the central panel 70B, but where the side floor panels 72B overlap and rest above the central floor panel 70B.

The central panel 70 shown in FIG. 5 is made of a thinner material thickness than the outermost side floor panels 72, 74. By having a base which has side parts of a different thickness, the tare weight of the container 10 itself can be reduced without comprising the strength of the container base under load. The base can be of a greater material thickness in those places where high stresses, extremes of bending load action or high hydrostatic loads are expected, and of a lesser material thickness where such loads and stresses are lower, or are supported by other means. For example, the container floor can be of a thinner material thickness at the central panel where that part of the floor can be supported by the centre sill 22 of a railway wagon undercarriage 12, and of a thicker material thickness in the outermost floor parts 72, 74 away from the centre sill 22 and nearest the join with the container side walls 24 where, in use, the floor is required to support the full hydrostatic weight of the bulk material contents of the container. In this way the tare weight of the container can be reduced, and thus the weight of bulk material to be carried by the container, and the gross to tare ratio of the container when loaded, can be improved.

In the embodiment shown, the side floor panels 72, 74 are joined to the central panel 70 by stitch welding, at various positions along the peripheral edge 80 of each of the side floor panels 72, 74 at the overlap 76, and as visible from the underside of the floor 29. The side floor panels 72, 74 are also joined to the central panel 70 by continuous welding, at various positions along the peripheral edges 82 of the central panel 70 at each overlap 76, as visible from the interior of the container 10. The use of a continuous weld in this location is principally for strength and to prevent the ingress of bulk material dust via any small space between the overlapped floor panels 70, 72, 74 during use of the container 10.

In the embodiments shown in the Figures, the position of the overlap 76 of the central floor panel 70 and one of the side floor panels 72, 74 is intermediate a centreline 84 of the container floor 29 and one of the side walls 24. In the arrangement shown, the overlap 76 can be arranged at a wheel arch 86, which is a floor recess that extends along the full length of the container base and in which the wheel sets 16 of the bogies 14 are positioned when the container 10 is seated on a railway undercarriage 12. In the embodiment shown, the overlap 76 extends along a full length of each of those wheel arches 86.

In further embodiments, the wheel arches need not extend along the full length of the container floor, and may instead only be discrete recesses at some portions along the length of the container floor, positioned above the specific location of each wheel of the two bogies.

In further embodiments, the floor panels need not be disposed adjacent in a horizontal plane, but can be angularly disposed with respect to each other. For example the side floor panels may be upwardly sloping with respect to a horizontal central floor panel. The panels themselves do not need to be planar, but can be curved or formed into other suitable geometric shapes, depending on the application and the desired shape of the container floor. Instead of the side floor panels (those furthest from the wagon centreline) being of a thinner material thickness than the central floor panel, the reverse configuration could be arranged. Although the panels in the embodiment shown in the drawings are at least partially joined together by stitch welding, other types of welding, such as continuous welding, may be solely utilised. Indeed, other methods of joining the floor panels together are also envisaged, for example involving use of an adhesive substance, heat treating the join region to cause fusion of the panels, or physical connection means such as screwing, bolting, forging or riveting, etc.

In still further embodiments, the floor of the container can be made up of a unitary sheet positioned between respective container side walls. The sheet can be integrally formed to have different material thicknesses in different locations, for example, by being heated and then drawn or rolled, so that the central part of such a sheet is formed relatively thinner than outer parts of the sheet.

In the embodiments shown in the Figures, the three-part container floor of varying plate thickness that has now been described, is shown in combination with container side walls that comprise panels of different material thicknesses that are disposed one above the other to form a container side wall, as also described. In still further embodiments, such a container floor arrangement need not be present in combination with such a side wall arrangement, and either of these can be present in combination with a respective conventional container side wall or floor.

Now that preferred embodiments of the invention have been described in some detail it will be apparent to those skilled in the art that the bulk material transport container has at least the following advantages:

1. When loaded, it is surmised that a container would experience the greatest side wall and floor stress in the lower side walls and in the regions of the floor outermost from the container centreline. By having walls and a floor which have parts of a different material thickness, the tare weight of the container itself can be reduced without comprising the strength of the container under load. The side walls and floor can be of a greater material thickness in those places where high stresses or hydrostatic loads are expected, and of a lesser material thickness where such loads and stresses are lower. In this way the overall tare weight of the container can be reduced, and thus the weight of bulk material to be carried by the container, and the gross to tare ratio of the container when loaded, can be improved.
2. The use of an overlap of sheet material in the construction of the wall or floor of the container removes the need to use butt edge welding techniques and the sheet(s) of metal material used do not need to have accurate end cuts or alignment. Instead the freedom to use a stitch weld provides an adequate and rapid method of joining two adjacent parts, and in some of the embodiments described, such a weld can be supplemented by the use of a continuous weld on another side of the parts being welded. Consequently the construction of those containers can be simplified and material wastage reduced, thus reducing manufacturing costs compared with known techniques.

Those skilled in the art will appreciate that the invention described herein is susceptible to variations and modifications other than those specifically described. All such variations and modifications are to be considered within the scope of the present invention the nature of which is to be determined from the foregoing description.

In describing the preferred embodiment of the invention illustrated in the drawings, specific terminology has been used for the sake of clarity. However, the invention is not intended to be limited to the specific terms so selected, and it is to be understood that each specific term includes all technical equivalents which operate in a similar manner to accomplish a similar technical purpose. Terms such as "uppermost", "lowermost", "peripheral", "upward", "downward", and the like are used as words of convenience to provide reference points and are not to be construed as limiting terms.

It is to be understood that, if any prior art information is referred to herein, such reference does not constitute an admission that the information forms a part of the common general knowledge in the art, in Australia or any other country.

In the claims which follow and in the preceding description of the invention, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

The invention claimed is:

1. A railway wagon for carrying bulk materials, the wagon comprising two side walls, two end walls and a base, at least a portion of one or each side wall comprising two discrete side wall parts, wherein a bridging member is arranged to interconnect the respective side wall parts by being connected to each side wall part at locations vertically spaced apart on the side wall, the bridging member being elongate and arranged in use to extend at least part way along a respective side wall from one end wall to an opposing end wall, the bridging member being in the form of a stiffening bracket having two or more mutually inclined parts in cross section, a top edge and a bottom edge and being connected to the side wall parts only at the top and bottom edges of the bridging member so that the top edge is connected to a side wall part and the bottom edge is connected to another side wall part.

2. The wagon according to claim 1, wherein each side wall part is formed as a panel having a respective constant wall thickness and the two side wall parts are joined together, the bridging member is not part of any of the side wall parts and is disposed inside the wagon, the side wall parts are each of a different material thickness and are aligned in common plane or in parallel planes, the two side wall parts are disposed one above the other, and the lower side wall part has a greater material thickness than the upper side wall part.

3. The wagon according to claim 2, wherein the two side wall parts partially overlap and are joined at the overlap.

4. The wagon according to claim 3, wherein the join at the overlap is achieved by means of a weld.

5. The wagon according to claim 4, wherein the weld is stitch weld.

6. The wagon according to claim 2, wherein distal end regions of the bridging member are welded to the respective ones of the side wall parts.

7. The wagon according to claim 6, wherein the weld between each of the distal ends of the bridging member and the side wall parts in a continuous weld.

8. The wagon according to claim 2, wherein the bridging member incorporates first and second mutually inclined parts.

9. The wagon according to claim 8, wherein the bridging member has an L-shaped profile in cross-section.

10. The wagon according to claim 2, wherein the bridging member is positioned so as to face an interior of the wagon, said interior being the region bounded by the side walls, end walls and base.

11. The wagon according to claim 2, wherein the bridging member extends along said wall intermediate upper and lower ends of said side walls.

12. The wagon according to claim 2, further comprising a capping joined to one of said wall parts so as to form at least part of an upper edge of said side wall, and a second bridging member arranged to interconnect said capping and said wall part.

13. The wagon according to claim 2, further comprising a capping that forms at least part of an upper edge of said side wall.

14. The wagon according to claim 12, wherein the capping has a first portion that is joined to the panel and a second portion that is angularly disposed from the first portion.

15. The wagon according to claim 13, wherein a second bridging member extends from the second portion to the panel so as to form a closed section at an upper edge of the side walls.

16. The wagon according to claim 12, wherein the capping has an L-shaped profile in cross-section positioned atop the side wall panel and at a rim of an opening to the interior of the wagon.

17. The wagon according to claim 2, wherein the bridging member forms a stiffener for the side wall.

* * * * *